US007146807B1

(12) United States Patent
Mondelci

(10) Patent No.: US 7,146,807 B1
(45) Date of Patent: Dec. 12, 2006

(54) EXHAUST MANIFOLD HEAT SHIELD

(76) Inventor: Thomas H. Mondelci, c/o Nopro Inc 385 Town St., East Haddam, CT (US) 06423

( * ) Notice: Subject to any disclaimer, the term of this patent is extended or adjusted under 35 U.S.C. 154(b) by 46 days.

(21) Appl. No.: 10/966,249

(22) Filed: Oct. 15, 2004

Related U.S. Application Data

(60) Provisional application No. 60/511,499, filed on Oct. 15, 2003.

(51) Int. Cl.
*F01N 3/02* (2006.01)
*F01N 7/10* (2006.01)
*F01N 7/00* (2006.01)

(52) U.S. Cl. ..... 60/321; 60/323; 60/320; 440/88 G; 440/88 J

(58) Field of Classification Search ..... 60/320, 60/321, 323; 440/88 G, 88 J
See application file for complete search history.

(56) References Cited

U.S. PATENT DOCUMENTS 1,388,480 A * 8/1921 Paris ..... 208/129
4,179,884 A 12/1979 Koeslin ..... 60/321
4,214,443 A * 7/1980 Herenius ..... 60/321
4,612,767 A * 9/1986 Engquist et al. ..... 60/321
4,914,912 A * 4/1990 Akatsuka ..... 60/323
5,148,675 A * 9/1992 Inman ..... 60/321
5,347,810 A * 9/1994 Moore, III ..... 60/323
5,488,826 A 2/1996 Paas ..... 60/299
5,953,912 A * 9/1999 Kaiho et al. ..... 60/323
6,318,077 B1 * 11/2001 Claypole et al. ..... 60/303
6,598,389 B1 * 7/2003 Chen et al. ..... 60/323
6,604,358 B1 * 8/2003 Durr et al. ..... 60/323

* cited by examiner

*Primary Examiner*—Thomas Denion
*Assistant Examiner*—Loren Edwards
(74) *Attorney, Agent, or Firm*—C. Nessler

(57) ABSTRACT

A heat shield for an internal combustion engine used in a boat, or other application where engine compartment heat is unwanted, has a water cooled body positioned around, but spaced apart from, the exterior surfaces of the exhaust manifold of the engine. The concavity of the heat shield body fits the manifold and engine closely, to intercept and carry away radiant and convective heat. The shield is held in place by means of a boss which is captured between the exhaust manifold and the exhaust pipe of the engine. The shield enables industrial engines to be adapted to marine use without re-certification to meet environmental regulations.

16 Claims, 2 Drawing Sheets

EXHAUST MANIFOLD HEAT SHIELD

This application claims benefit of provisional patent application Ser. No. 60/511,499, filed, Oct. 15, 2003.

TECHNICAL FIELD

The present invention relates to means for controlling heat which emanates from exhaust manifolds of internal combustion engines, in particular, within confined spaces such as the hull of a boat.

BACKGROUND

When a typical internal combustion engine is used in a boat, engine coolant flows in a closed loop through the engine block and a heat exchanger which transfers the waste engine heat to the water body in which the boat floats.

Typically, elevated temperature exhaust gas from each engine combustion chamber is collected by an exhaust manifold which is affixed to the engine block, so the gases can flow down an exhaust pipe which penetrates the boat hull. The exhaust pipe typically has a water jacket, through which is flowed the engine coolant. The purpose of such is to limit heat loss from the exhaust pipe, so that things or persons in the boat might not be harmed by contact with the hot pipe, and to limit heating of the boat interior. In engines expressly made for marine use, the exhaust manifold is typically water cooled, for the same reason the exhaust pipe is cooled. Typically, a cooled exhaust manifold is a casting or weldment that has hollow walls, to form an integral water jacket within which coolant water circulates. Such manifolds work well, but of course are substantially more costly to make than uncooled manifolds.

Industrial engines (those designed for uses other than marine) typically have uncooled exhaust manifolds. But because of the wider diversity and availability of industrial engines, it is often desirable to adapt them to boat use. However, in doing that the heat loss from the manifold can be a problem. In addition to the reasons just given, further heat-related difficulties can arise when the engine is contained within a sound insulating enclosure. The enclosure tends to prevent convection and radiation which otherwise occur. Thus, the temperature within a sound shield enclosure can rise to the point of deteriorating the sound insulating materials, or organic components near the engine.

However, even ignoring cost considerations, a water cooled manifold cannot be conveniently installed in replacement of the uncooled manifold on an industrial engine, to adapt it for marine use, even though from an engineering and engine performance standpoint, that would be fine. The reason is that current environmental regulations of the United States and other countries, relating to gaseous emissions of internal combustion engines, require testing and certification of internal combustion engines, including those used in land vehicles, stationary applications, and marine vessels. Once certified, changes in the design of any component, from the intake inlet to exhaust outlet port—thus including the exhaust manifold, cannot be made without securing further regulatory approval. So, if an industrial engine is certified for its land-based use with an uncooled manifold, it cannot be re-fitted with a cooled manifold and installed in a boat, unless the engine is re-certified. Recertification can be costly and time consuming. The apparent basis for the recertification requirement is that the cooler running manifold can effect engine emissions. Thus, the use of industrial engines in boats is inhibited, in large part because it is often not economically feasible for makers of land-use engines to have them re-certified for marine use, if the expected volume is low, as it often will be.

There is thus a need for a way to install industrial engines in boats while minimizing heat loss from the exhaust manifold, without the high cost of re-certification to meet environmental regulations.

SUMMARY

An object of the present invention is to reduce heat loss from an internal combustion engine to any confined space which contains the engine, in particular to the interior of a power boat hull. A further object of the invention is to economically adapt a land-use engine to marine-use, by reducing exhaust system heat loss, without necessitating a change in the physical configuration or performance of any environmentally-regulated component of the engine, and thus to avoid environmental regulation-related re-certification.

In accord with the invention, a heat shield for an internal combustion engine comprises a water cooled body or housing which is positioned around, and spaced apart from, the exterior surfaces of the exhaust manifold of the engine. The heat shield body has an interior concavity which is shaped to at least partially encompass the manifold, and to receive and carry away radiant and convective heat from it. Preferably, the heat shield has a concavity with only one vertical side opening, so the whole manifold is substantially enveloped by the heat shield. The heat shield preferably has a hollow wall construction, to define internal spaces through which coolant flows. Preferably, the heat shield comprises a hollow boss which passes through the shield sidewall, so the shield may be positioned in place relative to the manifold, by capturing the boss in the joint between the exhaust manifold and the exhaust pipe of the engine. In such instance, the heat shield body portions which define the concavity cantilever inwardly from the boss location, toward the engine, so the shield concavity largely envelops the manifold, and so the edge or periphery of the concavity comes close to the engine block.

The coolant flowing through the heat shield carries heat away from the manifold, so the heat is carried outside the boat hull to a heat sink. Preferably, the coolant is the same coolant which is used for cooling the engine block, and when that is such, the housing of the heat shield may further comprise a reservoir for receiving and supplying coolant to the engine cooling system.

The heat shield is useful with engines in boats and any other application where engine compartment heat is unwanted. The shield enables industrial engines to be adapted to marine use without environmental regulation re-certification.

The foregoing and other objects, features and advantages of the present invention will become more apparent from the following description of preferred embodiments and accompanying drawings.

DESCRIPTION

The invention is described in terms of its application to a propulsive engine which is positioned within the hold of a boat. It will be understood that that the invention will be applicable to any other engine use and to other kinds of boat and non-boat installations, in which it would be desirable to lessen exhaust manifold heat loss to the space around the engine.

Figure 1:
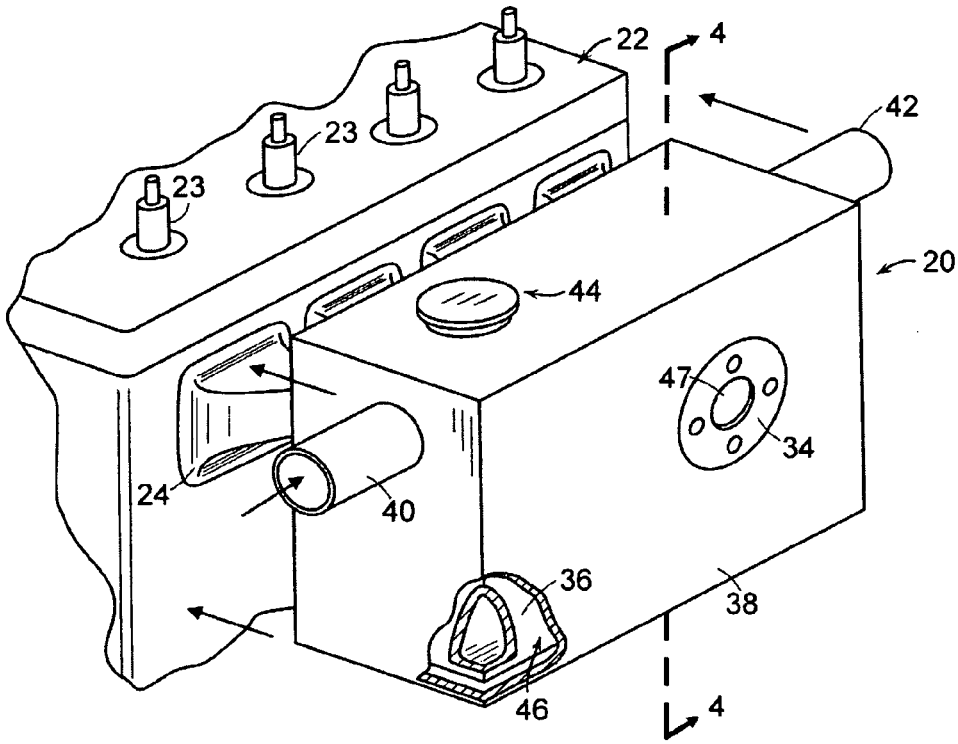
FIG. 1 is an isometric view of a heat shield showing how it is positioned on the side of an engine block, for attachment to the exit flange of the exhaust manifold.
Figure 2:
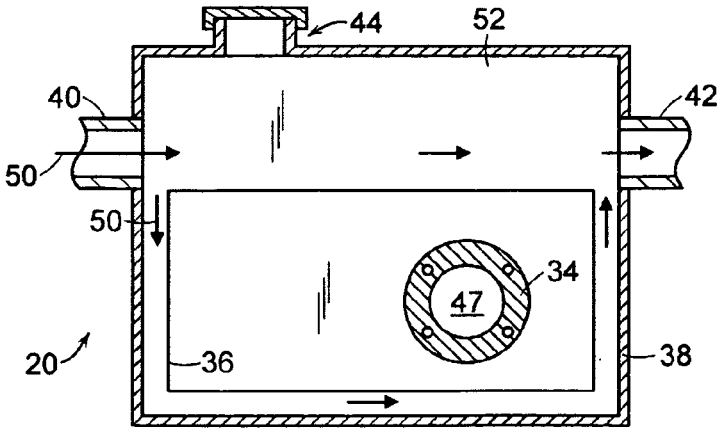
FIG. 2 is a vertical length wise cross section through the heat shield.
Figure 4:
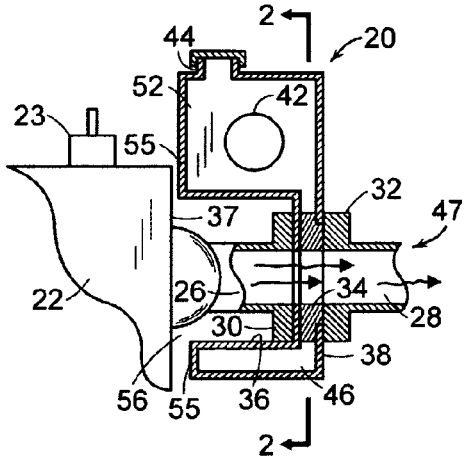
FIG. 4 is a vertical end view cross section of the heat shield, as it is captured within the exhaust system of the engine, as also shown by FIG. 1.

FIG. 1 is an isometric view of an engine 22 with a heat shield 20 of the present invention. The heat shield is shown pulled away from the engine 22, to make visible the exhaust manifold 24 on the side of the engine. FIGS. 2 and 4 are vertical plane cross sections of the heat shield. FIG. 4 shows the heat shield in its working or use position, where a portion of the heat shield body is captured in the joint between the manifold and the exhaust pipe joint, and where the heat shield body is cantilevered inwardly toward the engine. Engine 22 is shown in semi-schematic fashion, suggesting that is has four vertical cylinders and associated spark plugs or diesel fuel injectors 23, and an exhaust manifold 24 on the side of the engine block. An example of engine with which the heat shield may be combined is an Isuzu Model 4LC or 4LE engine (Isuzu Motors America, Inc., Cerritos, Calif., U.S.). The invention will be useful with other brands and kinds of engines, including those having fewer or more cylinders, and other cylinder head orientations.

Figure 3:
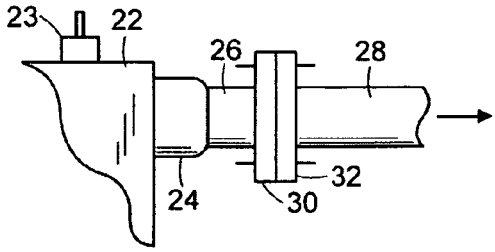
FIG. 3 PRIOR ART
FIG. 3 shows is a vertical elevation end view an engine having an exhaust manifold and exhaust pipe, prior to attachment of the heat shield of the invention.

FIG. 3 shows how engine 22 is connected to a typical exhaust pipe 28 in absence of the invention. Exhaust manifold 24 has an exit port 26 and associated flange 30. When installed in a boat, flange 30 is bolted to flange 32 of exhaust pipe 28. In use of the invention, the boss 34 of heat shield 20 is sandwiched between exit port flange 30 and exhaust pipe flange 32. See FIG. 4. The boss has opposing parallel faces, a central hole or passage 47 for exhaust gas, and bolt holes.

As shown in FIGS. 1, 2, and 4, exemplary heat shield 20 has a concavity 56 into which fits manifold 24. The reservoir portion 52 of the heat shield body, which is vertically above the manifold, provides space for extra liquid coolant. Lower body portions of the heat shield 20, which help define the concavity, comprise double walls, namely inner body part 38 and outer body part 36. The space 46 between the double walls enables coolant circulation. Welded boss 34 runs through the vertical portion of space 46, to connect the vertical side walls of parts 36, 38. The boss provides an exhaust gas passageway 47 through the heat shield. See FIG. 4. In another way of describing the heat shield as-installed, the heat shield body which defines the concavity cantilevers inwardly from the boss, toward the engine. Thus, heat that convectively and radiantly emanates from the engine manifold is received by the surfaces of the heat shield, and is then carried away by the coolant flowing through the heat shield.

The edge or periphery 55 of the concavity 56 is positioned closely to the side 37 of the engine. With the kind of engine shown, the edge of the concavity substantially lies along a vertical plane. The concavity will have other shape peripheral edge openings, to suit other engines. The gap between the edges of the shield around the concavity and the vertical surface of the engine block is made small. The purpose is to minimize the space through which radiant heat loss and convective air circulation from the manifold may pass, inasmuch as air which is heated by the manifold will tend to rise upwardly within the concavity 56, then to flow laterally along the cooled interior top of the concavity. Optionally, strips or fillers of metal or other material may be attached to the heat shield or the engine, in order to get a good fit in particular installations.

Preferably, the heat shield is cooled by the same liquid circulation system which cools the combustion chambers within the engine block. An independent system may alternatively be used; and, for example, gas coolant, e.g., air, may be less preferably used in substitution of the liquid coolant.

In the preferred embodiment, liquid engine coolant flows as indicated by arrows 50, through inlet pipe 40, through the interior spaces or passageways of the heat shield, and then out the exit pipe 42. Convection and turbulence will cause flow of coolant through the spaces 46 which are between the inner wall 36 and outer wall 38. The boss will also thus be cooled. Interior baffling, not shown, but within the skill of an artisan, may be used to distribute the coolant flow through passageway spaces of the heat shield body, for best effectiveness of coolant. Thus, during use heat received by the heat shield is carried away and discharged in the liquid coolant heat exchanger, or other means associated with waste heat from the engine block cooling system.

Figure 5:
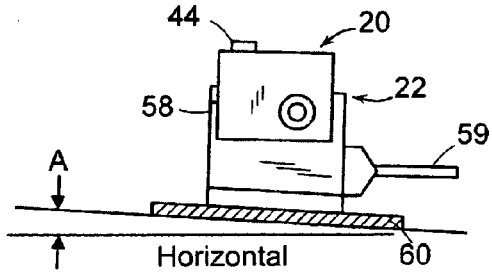
FIG. 5 is a side elevation view of a engine mounted within a boat hold on a slight slope, to show how the heat shield is affixed to such an engine.
Figure 6:
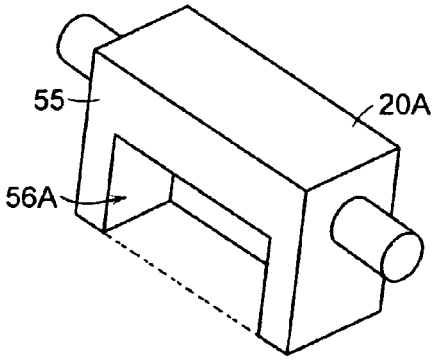
FIG. 6 is an isometric view of an alternate embodiment heat shield where the concavity has an open bottom.

In a simple embodiment, the heat shield is simply plumbed in as another element in the cooling system of the engine. Preferably, in doing such, the heat shield has a further function, which comprises a reservoir and expansion tank part of the engine cooling system, as shown in the Figures. That will now be further described. A normal engine block cooling system needs a container which will accommodate coolant volume changes during operation and non-operation of the engine. The container will also act as a reservoir, to accommodate minor leakage of coolant. So, in a preferred embodiment, the upper interior part of the heat shield comprises a space 52 which serves as a reservoir for coolant, thus ideally substituting for, and eliminating the need for, whatever other reservoir or expansion tank might be provided for engine block cooling. Filler pipe 44, which may be fitted with a familiar pressure relief type cap, enables liquid to be added to the system at the reservoir. As illustrated by FIG. 5, the filler pipe 44 for the reservoir of heat shield 20 is located toward the front end 58 (the end away from the drive shaft) of a boat propulsion engine, which typically down-slopes along the line of propeller shaft 59, at angle A to the horizontal. In other embodiments, such as shown in FIG. 6, the heat shield may comprise a reservoir only, and the filler pipe is located elsewhere in the coolant circulation system.

The heat shield is preferably fabricated as a weldment or casting, and made of suitable ferrous or non-ferrous material, e.g. steel, aluminum alloy, or cast iron. Suitable high performance plastic materials might be selectively used.

In the preferred practice of the invention, shown in FIGS. 1, 2 and 4, and in variations which achieve the same result, the heat shield concavity, abetted by any strips or fillers, is shown and defined as substantially enveloping the manifold. The concavity 56 of the heat shield preferably forms a rectanguloid or box-like structure, with only one vertical side opening, as pictured in FIGS. 1, 2 and 4. Other configurations of concavity may be used, within the invention. For example, the interior may be other than rectanguloid and may be curved. For example, as shown in FIG. 6, heat shield 20A has concavity 56A which comprises a water cooled top and side walls, and an open bottom 72. In still another embodiment, the bottom of concavity 56A of shield 20A may be closed by a solid sheet, which can be either uncooled or only cooled by conduction at the edges. In still other embodiments, selected portions of the vertical running side walls of the heat shield concavity may be solid instead of double wall.

While the exterior of the heat shield body shown in the Figures has a simple essentially vertical planar shape, more complicated exterior shapes may be used. Additional concavities or ribbing and the like may be placed on the exterior of the heat shield body, for instance to accommodate other components, to change volume, to provide structural strength, or to partially envelop the exhaust pipe, etc. When the boss means of attachment is used, and the portion of the heat shield defining the concavity cantilevers inwardly, other structure, including but not limited to a reservoir portion, may cantilever outwardly from the boss. Other means for cooling the heat shield may be used, in alternative to the hollow two-wall construction. For instance, when the reservoir function is not wanted, metal tubing may be adhered to the surfaces of a sheet metal body.

The boss 32 is preferably as shown, that is, as a simple substantially cylindrical structure with parallel opposing faces, more complicated bosses may be used. For instance, the boss may have non-parallel opposing faces, and or the faces may be more substantially spaced part, and or the boss may act as an adapter, from one type of connection to another.

The boss is the preferred means by which the heat shield is securely and simply held in place. The configuration enables the concavity of the shield to envelop the manifold while enabling the heat shield to not contact the manifold. Optionally, other support or positioning means, such as straps or brackets running to engine system parts may be used to supplement the boss. Pins or the like within the concavity may be used, but are best avoided since they can raise environmental regulation issues relative to whether the manifold is being cooled. In the generality of the invention, the heat shield body may be supported relative to the engine by other means, and not a boss. For instance, brackets or clamps may be used to mount the shield from the engine or manifold. When such is done, the boss may be eliminated and replaced by through-hole or U-shape cutout in the lower part of the heat shield body, so the heat shield closely fits the manifold or exhaust pipe.

Compared to putting insulation onto the manifold, or to providing a water jacketed manifold, the presence of the invention heat shield is substantially "invisible" to the engine and exhaust manifold. Thus conditions on exhaust gas path within the engine and manifold are not affected, as they would be if the manifold itself was water cooled, or if thermal barrier insulation was used (wherein, the temperature of the manifold would be raised. Since the heat shield does not alter the configuration of the exhaust manifold or any other engine component, and does not affect gas path phenomenon within the meaning of environmental regulation, re-certification issues are avoided.

The heat shield of the present invention remains at a relatively constant and low (coolant) temperature, and mitigates any adverse effects on people or things, which might otherwise come into contact with the manifold. In the invention heat is carried away to the heat exchanger. That helps alleviate the build up of waste heat inside of a sound suppression enclosure or a boat hull, or other kind of engine compartment in non-boat applications.

Although this invention has been shown and described with respect to a preferred embodiment, it will be understood by those skilled in this art that various changes in form and detail thereof may be made without departing from the spirit and scope of the claimed invention.

I claim:

1. An internal combustion engine system comprising:

an engine block cooled by liquid coolant;

an exhaust manifold attached to the engine block, the manifold having an exhaust port fitting spaced apart from the engine block;

an exhaust pipe, having an end for connecting to said exhaust port fitting, for carrying away engine exhaust gases which flow from the engine block and through said manifold; and, a heat shield having a concave portion, at least partially enveloping the manifold, the interior of said concave portion spaced apart from the manifold by an air gap, for receiving heat from the manifold;

cooling passageways, upon or within the heat shield, for carrying away heat received by said concave portion; and, means for mounting the heat shield with respect to the exhaust manifold without any heat-transfer conductive contact with the manifold upstream of said exhaust port fitting.

2. The system of claim 1 where said means for mounting comprises: a boss having a gas passageway, connected to and captured between said exhaust port fitting and the end of the exhaust pipe, wherein the heat shield is thereby mounted with said concave portion cantilevered from the boss toward the engine; said passageway enabling gas flow from the exhaust manifold to the exhaust pipe.

3. The system of claim 1 wherein the heat shield has a double wall construction, wherein the spaces between the double walls provide said coolant passageways.

4. The system of claim 1 further comprising: means for flowing said liquid engine coolant through said coolant passage ways.

5. The system of claim 1 wherein the heat shield further comprises: a reservoir for liquid coolant.

6. The system of claim 1 wherein said concave portion has only a vertical planar opening adjacent the engine block.

7. The system of claim 1 wherein the heat shield concave portion has portions which are free of cooling passageways.

8. The apparatus of claim 1 wherein said engine is an industrial engine environmentally certified for land use with an uncooled manifold, and wherein apparatus is mounted within the hull of a boat.

9. A heat shield for use in combination with an exhaust manifold of an internal combustion engine, wherein the manifold has an exhaust port fitting adapted for attachment to the end of an exhaust pipe, which heat shield comprises:

a body having a concave portion with coolant passageways, the interior of the portion shaped for at least partially enveloping said manifold while maintaining an ambient air gap spacing there between, for receiving radiant and convective heat from the manifold during engine operation;

ports on said body, for flowing coolant to and from said passageways;

a boss attached to the body, for mounting the heat shield at the exhaust port fitting of the manifold, the boss having a first face for mating with said fitting; an opposing side second face for receiving the end of said exhaust pipe; and, an exhaust gas passageway connecting said faces; wherein the boss is attached to the body at one end of said concave portion, so said concave portion cantilevers from the boss location so that the concave portion is adapted to at least partially envelope a manifold when the boss is attached to said exhaust manifold fitting.

10. The heat shield of claim 9 wherein the body concave portion is a cavity having only one planar opening, so that when mounted on an exhaust manifold, the heat shield opening is adapted to lie in proximity to an engine to which the manifold is attached.

11. The heat shield of claim 9 wherein the body has double walls with spaces therebetween, wherein said spaces comprise said coolant passageways.

12. The shield of claim 9 wherein said body further comprises a reservoir for holding liquid coolant, the reservoir connected to said coolant passageways.

13. The shield of claim 9 wherein part of said concave portion lacks coolant passageways.

14. A method of adapting a liquid cooled land-use industrial engine for use in a boat, wherein the engine has an uncooled exhaust manifold and is environmentally certified by regulatory authorities for land use, to reduce heating of the interior of the boat which contains the engine within without substantially cooling the manifold and thereby changing the gas path conditions within the manifold during engine operation, which comprises:

surrounding at least a substantial part of the exterior of the exhaust manifold with the concavity of a heat shield, wherein the interior of the concavity is spaced apart from the manifold by an air gap;

flowing coolant through coolant passageways of the heat shield, to thereby carry away convective and radiant heat received from the manifold through the air gap during engine operation; and, avoiding cooling or heating of the manifold upstream of the exhaust exit port by contact with the heat shield.

15. The method of claim 14 wherein liquid coolant used to cool the engine is flowed through said heat shield coolant passageways.

16. The method of claim 14 further comprising: surrounding all sides of the manifold with said spaced-apart concavity except where the manifold is connected to the engine and where the manifold is connected to an exhaust pipe.

* * * * *